US008313282B1

(12) United States Patent
Jarrah et al.

(10) Patent No.: US 8,313,282 B1
(45) Date of Patent: Nov. 20, 2012

(54) COMPACT AIR-PLUS-LIQUID THERMAL MANAGEMENT MODULE

(75) Inventors: Yousef Jarrah, Casa Grande, AZ (US); Gregory M Chrysler, Sun Lakes, AZ (US); Patrick Harper, Phoenix, AZ (US); Shen Zhao, Tokyo (JP); Glen Meadows, Gilbert, AZ (US); Christopher Best, Phoenix, AZ (US); Hirofumi Shoji, Ishikawa (JP); Thang Ngugen, Scottsdale, AZ (US)

(73) Assignee: Minebea Co., Ltd. (JP)

( * ) Notice: Subject to any disclaimer, the term of this patent is extended or adjusted under 35 U.S.C. 154(b) by 564 days.

(21) Appl. No.: 12/553,052

(22) Filed: Sep. 2, 2009

Related U.S. Application Data

(60) Provisional application No. 61/147,539, filed on Jan. 27, 2009.

(51) Int. Cl.
*F01D 13/00* (2006.01)

(52) U.S. Cl. ..... 415/62; 415/143; 415/175; 415/178; 416/175; 165/80.4; 165/104.33

(58) Field of Classification Search ..... 416/198 R, 416/199, 201 A, 124, 125, 175, 203; 415/62, 415/67, 93, 64, 99, 101, 143; 165/80.4, 104.33
See application file for complete search history.

(56) References Cited

U.S. PATENT DOCUMENTS

| | | | | |
|---|---|---|---|---|
| 6,208,512 | B1 * | 3/2001 | Goldowsky et al. | 361/699 |
| 6,702,002 | B2 * | 3/2004 | Wang | 165/80.3 |
| 2006/0191669 | A1 * | 8/2006 | Chen et al. | 165/104.33 |

* cited by examiner

*Primary Examiner* — Edward Look
*Assistant Examiner* — Adam W Brown
(74) *Attorney, Agent, or Firm* — Fountainhead Law Group P.C.

(57) ABSTRACT

Disclosed is a compact and integrated fan, pump, and heat exchanger system where air-cooling is performed via the fan, liquid cooling is performed via a pump, and heat exchange fins in thermal contact with a fluid channel act as a heat exchanger. Heated fluid is carried inside the fluid channel, where heat therein is conducted to the fins. The air flows around the outside surfaces of the fins so that the heat transfers from the heated fluid into the air stream.

19 Claims, 16 Drawing Sheets

COMPACT AIR-PLUS-LIQUID THERMAL MANAGEMENT MODULE

CROSS-REFERENCES TO RELATED APPLICATIONS

This application claims priority from U.S. Provisional Appl. No. 61/147,539, filed Jan. 27, 2009 and is incorporated herein by reference in its entirety for all purposes. This application is related to co-pending U.S. application Ser. No. 11/958,755, filed Dec. 18, 2007 and is incorporated herein by reference in its entirety for all purposes.

BACKGROUND OF THE INVENTION

The present invention is related to fan and pump devices, and more specifically to liquid cooling systems using axial-flow fans and centrifugal pumps. The present invention is still more specifically directed to method and apparatus for liquid cooling using a compact configuration of axial-flow fan and centrifugal pump devices.

Classical cooling units utilize three (3) separate components (fan, pump, and heat exchanger) located far apart to continuously perform the desired function of removing heat out of a liquid. For example, automobiles have a cooling system which includes a fan, a pump, and a heat exchanger. Some electronics and avionics cooling systems also include the same three basic components, and some home air conditioning systems also utilize all three components.

The basic three components perform three basic functions: the fan delivers cold air; the pump delivers hot liquid; and the heat exchanger transfers heat from the liquid to the air. These three individual components are typically located far apart and thus occupy a large overall volume.

Axial flow fans are fans in which the direction of the flow of the air from inlet to outlet remains unchanged. Guides or stator vanes can be provided to smooth the airflow by minimizing or otherwise reducing swirl and thus improve air flow efficiency.

Centrifugal pumps are pumps that use a rotating impeller to increase the pressure of a fluid. The fluid enters the pump impeller along or near to the rotating axis and is accelerated by the impeller, flowing radially outward into a diffuser or chamber of a volute, from where it exits an outlet, and into a downstream piping system for example. A centrifugal pump typically includes a rotating impeller that increases the pressure of the incoming fluid. The centrifugal pump typically employs a diffuser to deliver the liquid radially into the volute and then into the outlet. The diffuser also increases the fluid static pressure.

BRIEF SUMMARY OF THE INVENTION

The disclosed invention provides a liquid cooling system comprising a unique combination of a fan and a unique pump/heat exchange component, thereby avoiding the need for a separate, space-consuming heat exchanger. The result is a compact and lower cost thermal system for liquid cooling. Of course, any fluid (such as air or other gases) other than a liquid can be cooled according to the present invention.

The inventors in a related application (U.S. application Ser. No. 11/958,755) have coined the term "fanpump" to describe a class of turbomachines which comprise two-wheels rotating about a common shaft, the first wheel is a fan and the second wheel is a pump. The present invention uses this term in a similar manner. The present invention integrates three functions, namely, air cooling, liquid cooling, and heat exchange into this single two-wheel turbomachine. The fan delivers air while the pump delivers liquid into a heat exchanger. The third function is performed at the interface between the air and heat exchanger as liquid flows inside the heat exchanger while air flows around the heat exchanger. Thus, although only two components (fan plus pump) are integrated, the "fanpump" device performs three (3) functions: the fan delivers air for cooling; the pump delivers liquid to be cooled; and at the surface of the heat exchanger heat is transferred from liquid to air to effect cooling of the liquid.

The fanpump cooling device, apparatus, or system can be driven by a common drive source, such as a common drive shaft. In the case of a motor-driven device, the drive shaft can be driven by a single motor. Still another alternative is to drive the fan portion of the fanpump device and the pump component with separate, independently controlled drive sources.

The present invention provides an integrated fan plus a pump and heat exchanger housed in a compact cooling system. Air cooling is provided via an airflow created by the axial-flow fan, liquid cooling is provided via the centrifugal pump, and a heat transfer process is performed by the heat exchanger where heat transfers from the relatively hot liquid to the air stream. The fan and the pump rotate about a common shaft. Cooling devices according to the present invention perform three functions simultaneously: the fan delivers pressurized air flow; the pump delivers pressurized liquid; and heat is exchanged as the hot liquid flows inside the heat exchanger while air is flowing about the heat exchanger.

The present invention eliminates the need for a separate heat exchanger by providing fluid flow within the heat exchanger. The present invention provides for airflow across the heat exchanger. Heat transfer is performed as the hot liquid flows inside the heat exchanger while the colder axial airflow passes across the outside of the heat exchanger.

DETAILED DESCRIPTION OF THE INVENTION

First, a description of embodiments disclosed in related U.S. application Ser. No. 11/958,755 is given. The discussion will then proceed with a description of illustrative embodiments in accordance with the present invention.

Figure 1A:
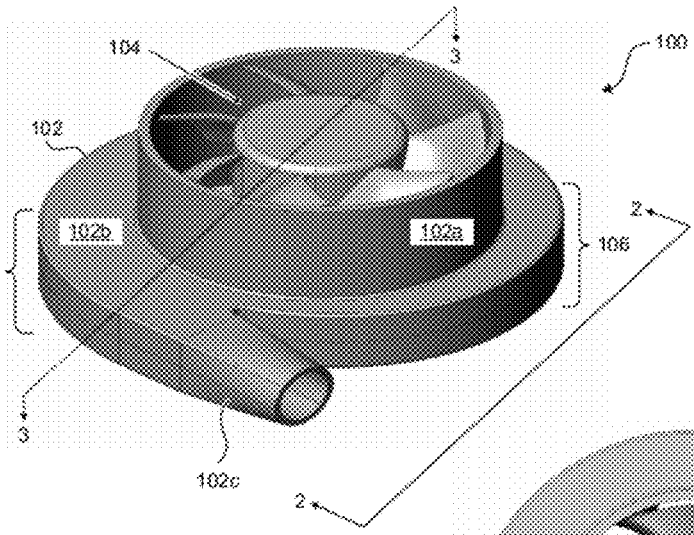
FIGS. 1A-1C show three views of an illustrative embodiment of an apparatus for cooling liquids in accordance with the present invention.
Figure 1B:
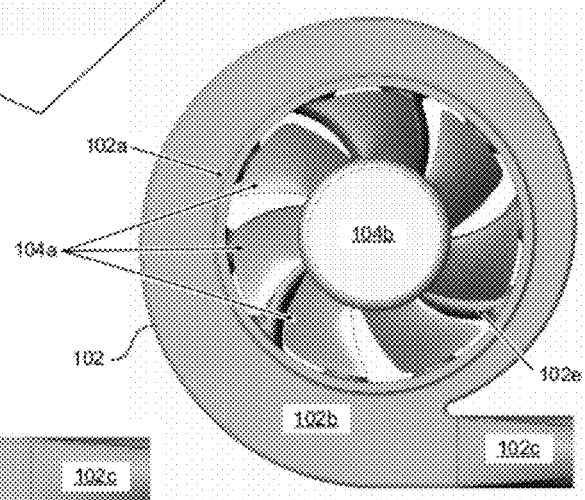
Figure 1C:
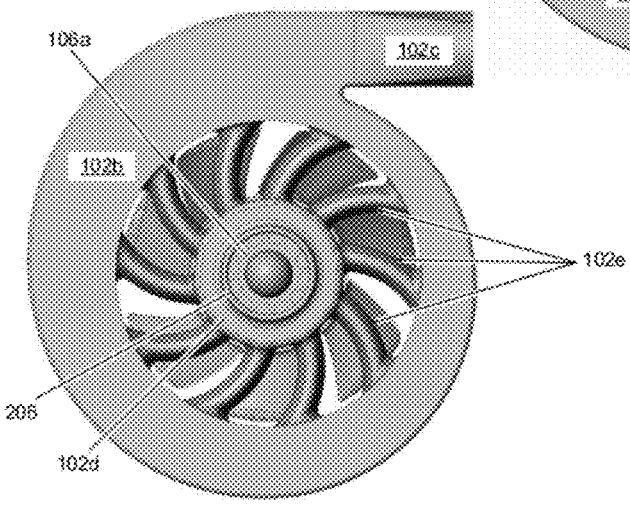

FIGS. 1A-1C show various exterior views of a cooling apparatus 100 according to an embodiment of the present invention. FIG. 1A is a perspective upper view of the cooling apparatus 100, while FIG. 1B is a top view looking down at the apparatus and FIG. 1C is a bottom view looking up. The cooling apparatus 100 includes among other elements to be discussed below, a housing 102 that houses an axial fan 104 and a centrifugal pump 106. The cross-sectional view of FIG. 3B more clearly shows the centrifugal pump 106. Axial fan and mixed-flow fan designs are known. Though embodiments disclosed herein show an axial fan, it is noted that fan 104 can be a mixed-flow fan in an alternate embodiment of the present invention. Likewise, the centrifugal pump and mixed-flow pump designs are known. Thus, although embodiments disclosed herein show a centrifugal pump, it is noted that pump 106 can be a mixed-flow pump.

Portions of the housing 102 of the cooling apparatus 100 in accordance with the present invention uniquely provide an enclosure (shroud 102*a*) for the axial fan 104 and at the same time provide various components for the centrifugal pump 106. For example, the housing 102 defines a fan housing for the axial fan 104. A portion of the housing 102 serves as a fan shroud 102*a* for the fan 104. The axial fan 104 sits within the space defined by the fan shroud 102*a*. The fan 104 comprises fan blades 104*a*. The fan blades 104*a* are connected to a fan hub 104*b*. The combination of the blades and hub is referred to as the impeller. The axial fan 104 shown in this and following figures is a generic fan design. However, a variety of axial fans and designs are known. Various fan blade (impeller) designs are known. It will be appreciated from the teachings of the present invention, that any suitable axial fan and impeller design can be used.

In accordance with the present invention, the housing 102 also defines various components comprising the centrifugal pump 106. For example, a pump shroud 102*d* houses a pump impeller component 106*a* of the centrifugal pump 106. The view of FIG. 1C shows only a small portion of the pump shroud 102*d*. A more complete view of the pump shroud 102*d* is given in FIG. 3B. The pump shroud 102*d* defines a pump inlet 206 (FIG. 2) of centrifugal pump 106 within which is disposed the pump impeller 106*a*.

The housing 102 also defines a diffuser component for the centrifugal pump 106 which is in fluid communication with the pump shroud 102*d*. Fluid entering the inlet 206 is forced under the pressure created by operation of the pump impeller 106*a* to flow into the diffuser. Unlike conventional diffuser designs, the housing 102 in accordance with the present invention defines a plurality of diffusers 102*e*. The diffusers 102*e* shown in the top view of FIG. 1B are partially obscured by the impellers 104*a*, but are shown in full view in FIG. 1C. A feature unique to the present invention is the shape of the diffusers 102*e*, they have a blade shape and thus are referred to herein as "diffuser blades" or "diffuser elements." This aspect of the present invention will be discussed in further detail below.

The housing 102 also defines the volute of the centrifugal pump 106 that is in fluid communication with the diffuser blades 102*e*. In accordance with the present invention, the housing 102 defines a hollow casing 102*b* which serves as the volute. Fluid flowing through the diffuser blades 102*e* will exit the diffuser blades into the chamber of the volute 102*b*. The housing 102 also defines a portion 102*c* which provides the pump outlet 208 of the centrifugal pump 106.

FIGS. 1A-1C show a unique combination of the axial fan 104 and the pump 106 integrated into a single compact unit requiring only a single housing 102 and single shaft (FIG. 3B) to drive both. Air flows along the axis of rotation via the action of the fan impeller 104*a*, and the fluid to be cooled is centrifuged via the action of the pump impeller 106*a*.

Figure 2:
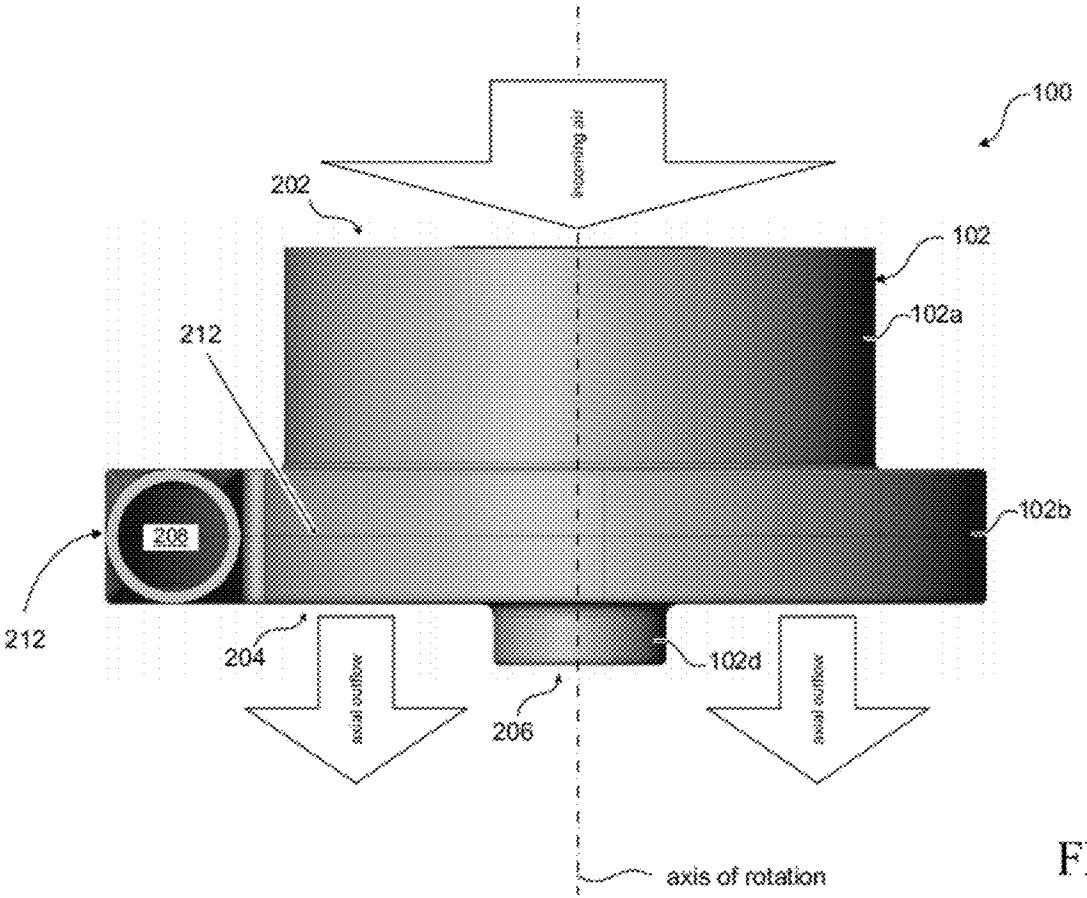
FIG. 2 is a side view of an illustrative embodiment of the apparatus shown in FIG. 1A.

FIG. 2 represents a side view of the illustrative cooling apparatus 100 of FIG. 1 taken from the view line 2-2 shown in FIG. 1A. This figure is used to illustrate the various fluid flows of the apparatus 100. Operation of the fan 104 will create a pressurized air flow. The incoming air enters through the airflow inlet 202 and is pressurized when the impeller 104 is spinning. This creates an axial flow of air that exits via the airflow outlet 204.

In an embodiment of the present invention, the housing 102 comprises two halves which fit together. A seem line 212 illustrated in FIG. 2 represents the line of contact between the two halves of the housing 102. The seem line can be seen in the other figures as well.

Figure 3A:
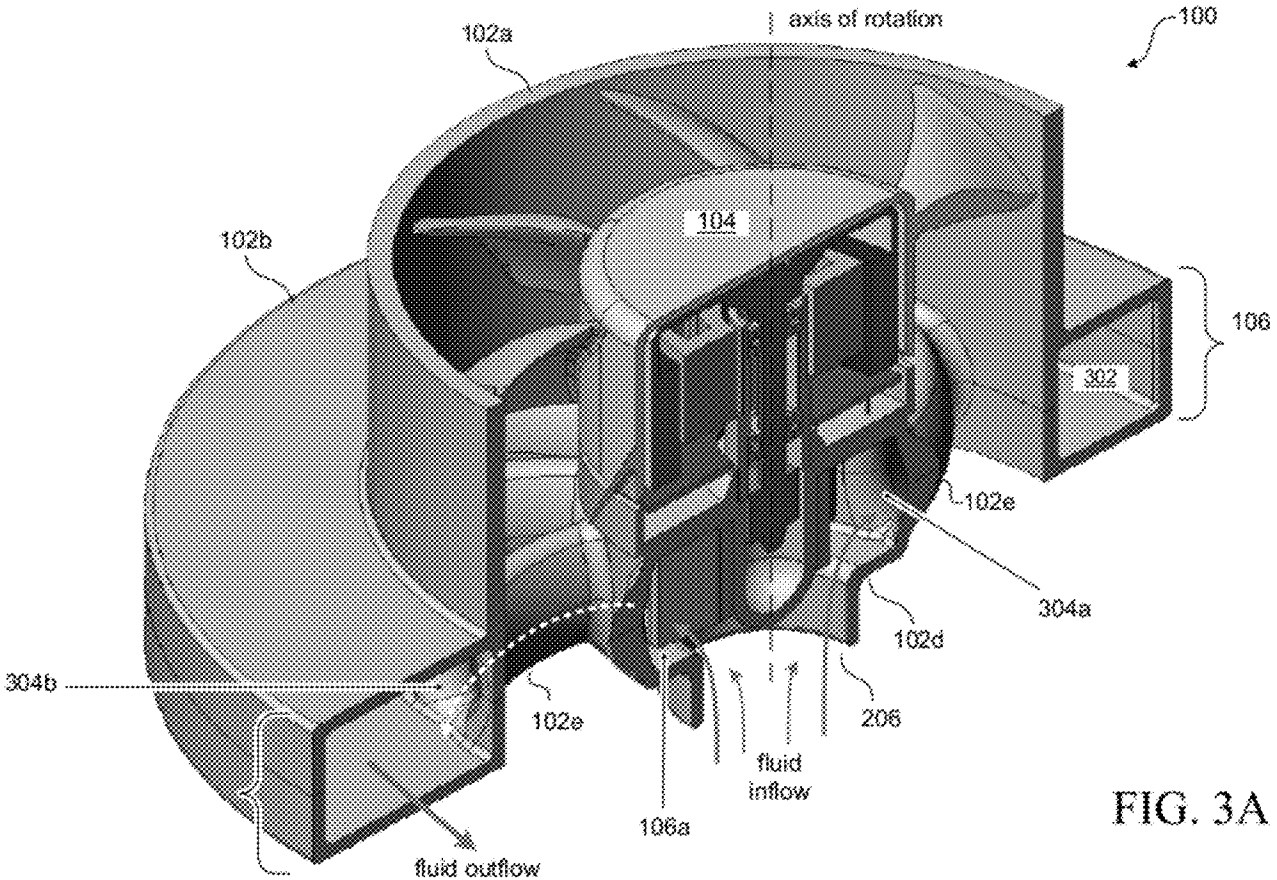
FIG. 3A is a perspective cutaway view of an illustrative embodiment of the apparatus shown in FIG. 1A.

FIG. 3A shows a perspective cutaway view of the illustrative embodiment of the cooling apparatus shown in FIG. 1A, taken from the view line 3-3. This figure shows more clearly the integration of the axial fan 104 and centrifugal pump 106 in accordance with the present invention.

As discussed above, a unique feature of the centrifugal pump 106 in accordance with the present invention is the array of diffuser blades 102*e* which collectively function as a conventional diffuser in a conventional centrifugal pump. Each diffuser blade 102*e* has an opening 304*a* into the volume of space defined by the pump shroud 102*d*, where fluid entering inlet 206 is pressurized by pump impeller 106*a*. Each diffuser blade 102*e* also has an opening 304*b* into the volute chamber 302, where fluid flowing through the diffuser blade exits.

As illustrated in FIG. 3A, fluid enters the centrifugal pump 106 via the pump inlet 206. In a specific application of the cooling apparatus 100, a source of fluid to be cooled is connected to the pump inlet 206. Though no details are provided in the figure, it is understood that the pump inlet 206 can be provided with a suitable fluid coupling mechanism to connect the apparatus 100 to a fluid source. The fluid can be a gas, but is more commonly a liquid such as water or other liquid coolant. Fluid entering the inlet 206 is pressurized by the spinning action of the pump impeller 106*a*, forcing the fluid into the diffuser blades 102*e* through the respective openings 304*a*. Fluid continues to flow through the diffuser blades 102*e* where it exits through respective openings 304*b* and into volute chamber 302. As can be seen in FIG. 1C, the diffuser blades 102*e* have a curved structure which directs the fluid in toward the outlet 208.

Figure 3B:
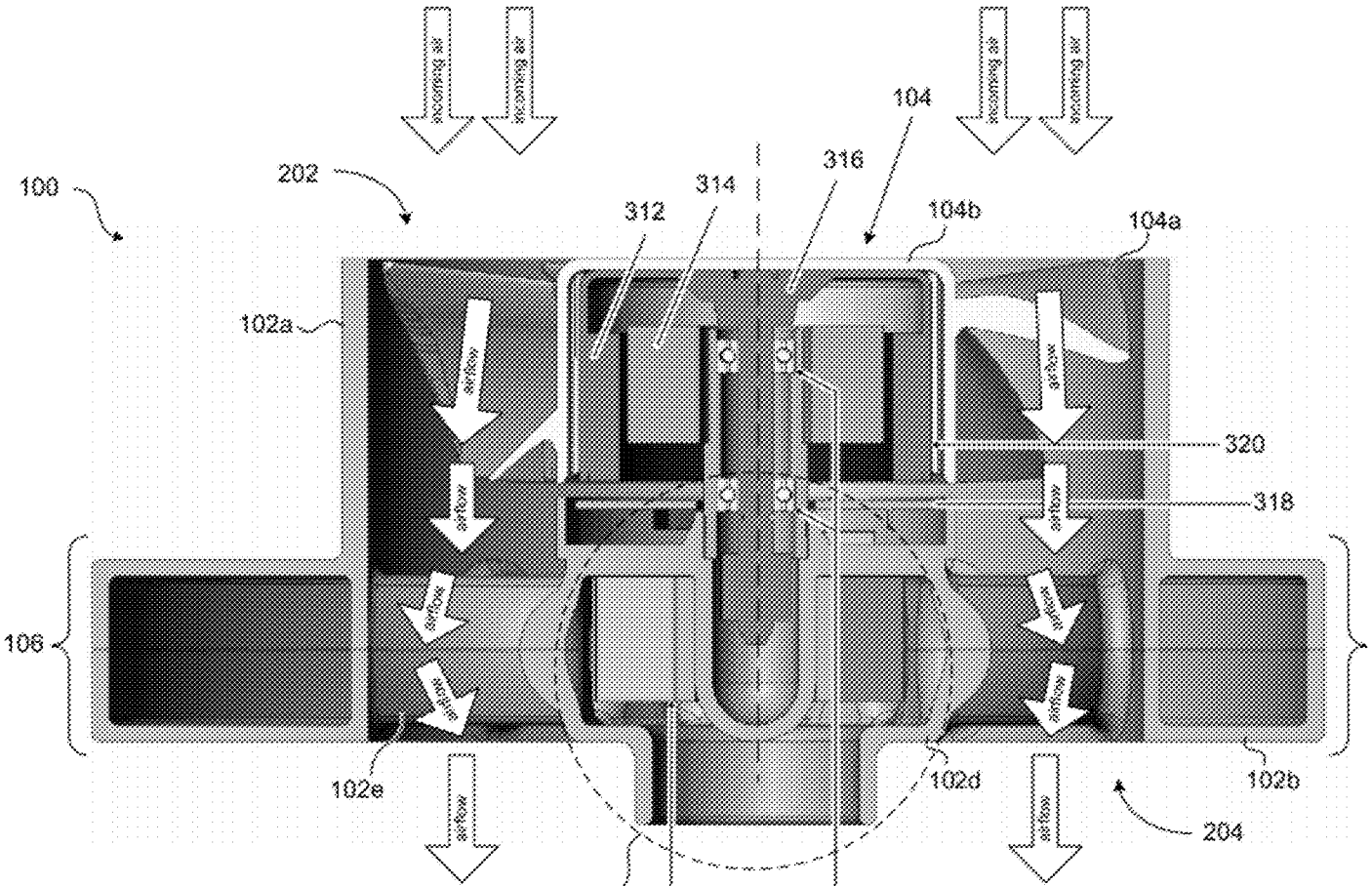
FIGS. 3B and 3C are plan views of the cutaway section illustrated in FIG. 3A.

FIG. 3B shows a straight-on view of the cutaway section illustrated in FIG. 3A. In a particular embodiment of the present invention, the axial fan 104 is driven by a motor provided in the fan hub 104*b*. FIG. 3B illustrates an example of a brushless DC (direct current) motor 320. It will be appreciated that any of a number of suitable conventional motor designs can be used, including brushed as well as brushless motors. The brushless motor 320 shown in FIG. 3B includes a permanent magnet rotor 312 connected to the hub 104*b*, so that rotation of the rotor will cause a corresponding rotation of the hub. The rotor 312 is attached or otherwise connected to a drive shaft component (spindle, axis, etc.) 316 for rotation about an axis of rotation. A stator 314 (more specifically a stator coil or stator winding in the case of brushless motors) is fixedly attached about the drive shaft 316. Motor drive electronics 318 are provided on a printed circuit board mounted near the base of the motor 320. Suitable connections are made between the motor 320 and the drive electronics 318, for example in order to provide drive current to the stator windings of stator 314, and in general to provide communication between the motor and the drive electronics.

In accordance with the present invention, the centrifugal pump 106 is driven by the same motor 320. In particular, the impeller 106*a* is mechanically coupled to the drive shaft 316, permitting the one motor to drive both devices, namely the fan 104 and the pump 106. The single motor, common drive shaft configuration is advantageous in that it allows for a simple, compact, and low cost unit.

However, it will be appreciated that alternative drive configurations, nonetheless, can be employed. For example, a common drive can be provided using a common drive shaft where the motor drive is provided at a location separate from the cooling apparatus 100. It may be desirable to drive the fan 104 with a source separate from the drive source for the pump 106. For example, it might be desirable to control the airflow velocity of the fan 104 and the fluid flow rate of the pump 106 independently of each other. Still other drive configurations can be employed without departing from the teachings of the present invention.

FIG. 3B shows how heat is transferred from hot liquid to the air in accordance with the present invention. The figure shows the path of the airflows created during operation of the fan 104. Air is pulled into the airflow inlet 202 of shroud 102*a* and is forced through the shroud to create an axial airflow that exits the airflow outlet 204. Along the way, the airflow passes across the surfaces of the diffuser blades 102*e* which are located in the path of the airflow and downstream of the airflow. When a fluid hotter than the airflow is made to flow through the diffuser blades 102*e*, heat from the fluid will conduct across the material of the diffuser blades and into the air of the airflow, thus cooling the fluid. It is noted that the direction of the airflow can be reversed; however, the cooling effect will be reduced.

Figure 3C:
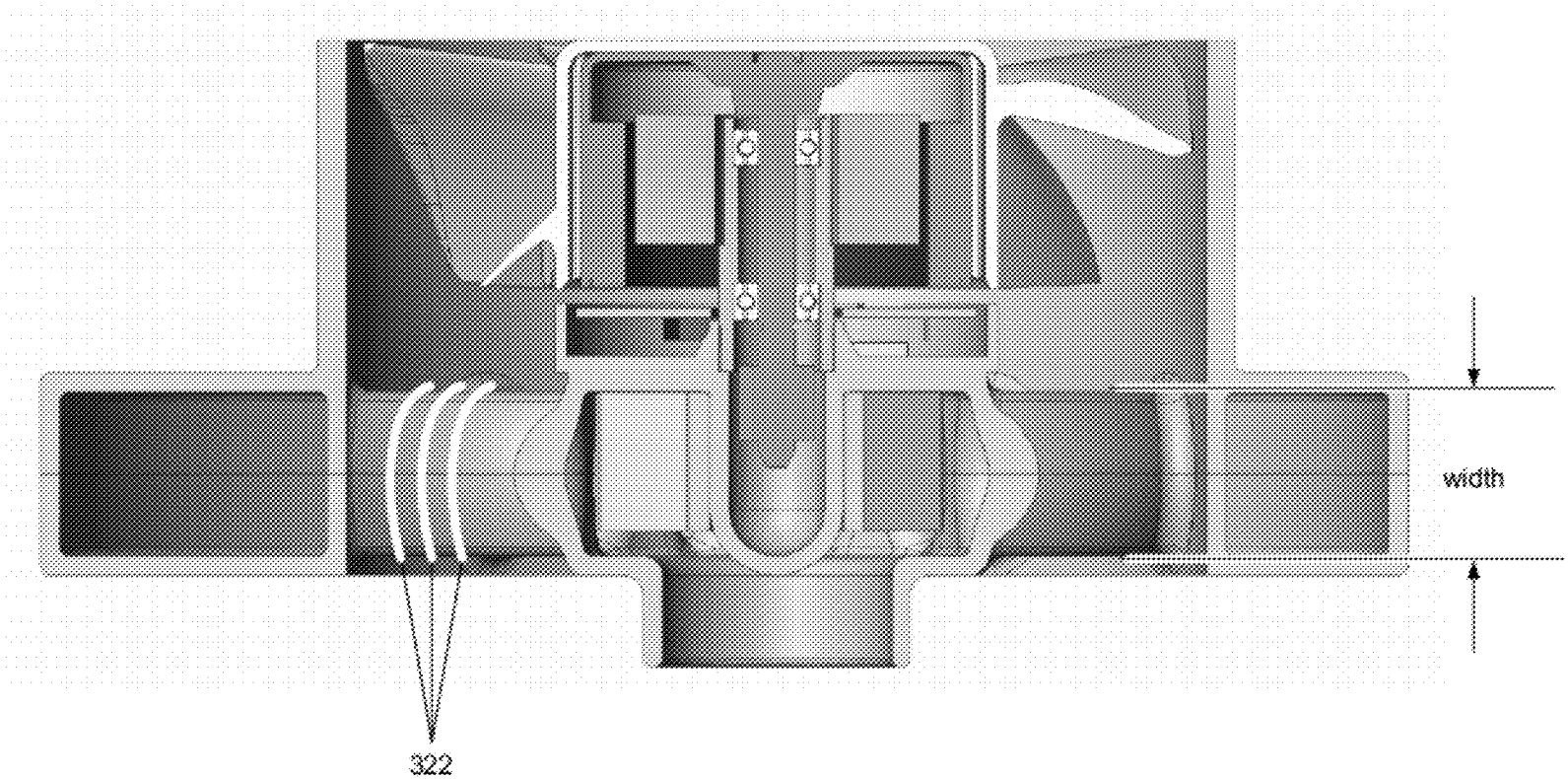

The width dimension shown in FIG. 3C of the diffuser blades 102*e* can be increased or decreased to provide greater or lesser surface thereby affecting the rate of thermal conduction for any given fanpump design. FIG. 3C shows the addition of "winglets" (or fins) 322 that can be formed on the surface(s) of the diffuser blades 102*e*. The winglets 322 further increase the surface area of the diffuser blade 102*e* for increased heat exchange capacity. The design and number of winglets 322 may be the same for each diffuser blade 102*e*, or can vary from one blade to another. Typically the winglets 322 extend from the surface of the diffuser blade 102*e* by a small distance, e.g., the thickness of a dime, but the specific dimension will depend on a specific application.

It is understood that larger and/or more numerous winglets 322 will improve heat exchange capacity, but generally at the cost of decreased airflow. Similarly, for the diffuser blades 102*e*, namely, larger and/or more diffuser blades 102*e* will improve heat exchange capacity, generally sacrificing airflow efficiency. The specific designs for the diffuser blades 102*e* and the winglets 322, including numbers of diffuser blades and winglets, will be dictated by the requirements of a specific application. Such design factors are beyond the scope of the present invention, but are nonetheless within the scope of understanding of those of ordinary skill in the art.

Figure 4:
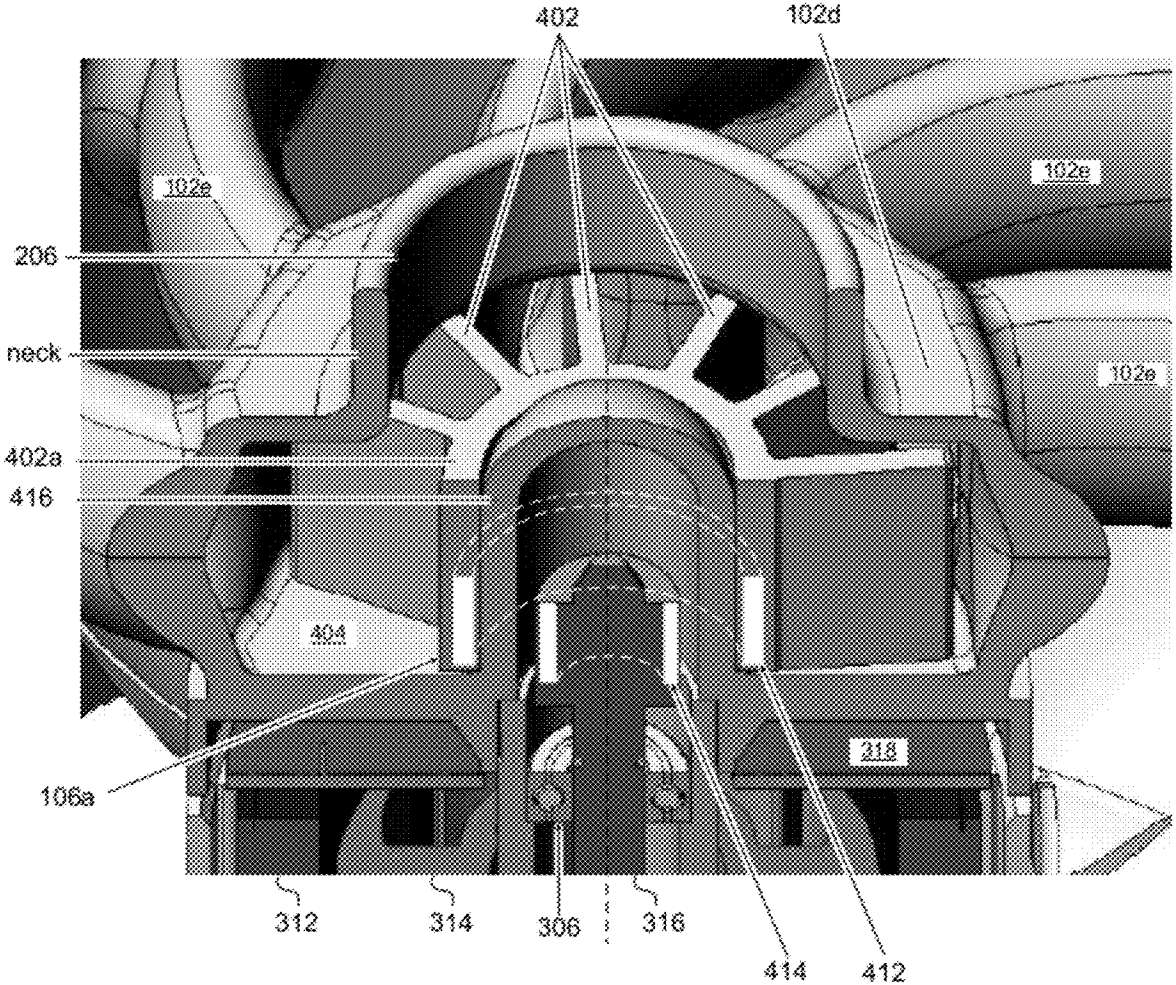
FIG. 4 is a blown up view of an area identified in FIG. 3B.

An enlarged view of the area in FIG. 3B identified by circle 4 is shown, upside down, in perspective in FIG. 4 and illustrates some additional details of the centrifugal pump 106. As can be seen in FIG. 4, the pump impeller 106*a* comprises impeller blades 402 attached to and radially arranged about an impeller ring 402*a*. The impeller ring 402*a* slidably fits about a finger 416. The pump impeller 106*a* spins about the finger 416 within the volume of space 404 defined by the pump shroud 102*d*.

A neck of the shroud 102*d* defines fluid inlet 206 and can be structured or otherwise fitted with a suitable coupling device to allow for cooling apparatus 100 to be connected to the source of fluid to be cooled. Diffuser blades 102*e* can be seen coupled to the pump shroud 102*d*.

FIG. 4 also shows portions of the motor drive components. For example, a portion of the stator 314 of motor 320 can be seen. Similarly, part of the permanent magnet rotor 312 can be seen. The PCB containing the drive circuitry 318 is also visible. As can be seen in the figure (also in FIGS. 3A and 3B), bearings 306 provide support for the drive shaft 316 within the housing 102.

In the embodiment of the present invention shown in FIG. 4, the ring of pump impeller 106*a* is provided with a permanent magnet ring 412. A corresponding permanent magnet ring 414 is provided about drive shaft 316. The magnets 412, 414 are aligned for mutual attraction between them so that when the drive shaft 316 spins the magnet 414, the magnet 412 likewise will spin thus driving the pump impeller 106*a*. As can be seen in the figure, the finger 416 provides a fluid-tight separation between the pump mechanics of the pump 106 and the fan mechanics of the fan 104.

An important aspect of the present invention are the drilled diffuser blades 102*e* which constitute a component of the centrifugal pump 106. First, as discussed above, they collectively perform the function of a conventional diffuser in a conventional centrifugal pump, namely to deliver the pressurized incoming fluid created by the impeller into to volute.

A second important aspect of the present invention, as can be seen in the figures, is that the diffuser blades 102*e* are disposed in the path of the airflow of the axial fan 104. Thus, the flow of fluid resulting from the pressure created by the spinning of the pump impeller 106*a* flows through the diffuser blades 102*e* which are connected to the pump shroud 102*d* and in fluid communication with the volume 404 within the shroud. The fluid consequently also flows in the path of the airflow of the axial fan 104. The diffuser blades 102*e* thus act as heat exchangers where heat is transferred from the hot fluid stream inside the diffuser blades to the cooler air stream outside.

A third important aspect of the present invention is the shape of the diffuser blades 102*e*. As can be seen in the figures, the diffuser blades 102*e* have a streamline shape. By placing the diffuser elements of the centrifugal pump 106 squarely within the path of the airflow (airstream), turbulence and swirl effects can arise in the airflow. By shaping the diffuser elements of the centrifugal pump to have a streamlined, aerodynamic shape, the diffuser blades 102*e* can de-swirl the airflow. Because the drilled diffuser blades are streamlined (i.e. outer surface is airfoil shaped) and located downstream of the fan impeller 104*a* they also act like de-swirl vanes (i.e., fan stator blades which remove swirl, created by the fan impeller, from the air stream).

In a particular embodiment, the diffuser blades 102*e* have an airfoil shape, and more generally have the general shape of a fan blade; hence the inventors have coined the phrase "diffuser blade" as a reminder that the diffuser elements of the present invention have two important functions: first, they are drilled so as to centrifuge (or diffuse) the fluid captured by the pump impeller 106*a*; and second, they are streamlined, i.e., they look like airfoils or fan blades in order to eliminate, minimize, or otherwise reduce air swirl and/or turbulence. The diffuser blades 102*e* therefore serve as conventional "stator blades."

It is noted that de-swirling the airflow, though very desirable, is not a critical element of the present invention though it is nonetheless a unique feature of the present invention. Aspects of the present invention include the placement of the diffuser blades 102*e* within the path of the airflow, allowing for the airflow to cool the hotter liquid flowing within the diffuser blades, and allowing for the ability to at least reduce swirl from the airflow. Thus, the diffuser blades 102*e* in accordance with the present invention perform three functions: they diffuse the fluid, they provide heat exchange, and they can de-swirl the airflow.

Another important aspect of the present invention is the integration of the axial fan 104 and the centrifugal pump 106 into a single unit, where the two rotating wheels (fan impeller 104*a* and pump impeller 106*a*) have a common shaft, motor, and drive housed in a common housing 102. The centrifugal pump design of the present invention allows for the diffuser component of the pump 106 to be placed inline with the airflow of the fan 104 in a compact, space-efficient manner. The design and placement of the volute 102*b* of the pump 106 is equally important in arriving at a compact, space-efficient device.

As noted above, the housing 102 can be formed of two halves (or more pieces). Each half (piece) can be an injection molded piece. The material can be any suitable type of plastic, or any other material. Preferably, the material that is used has suitable thermal qualities as to promote efficient heat conduction in the diffuser blades 102*e*.

In an embodiment, the diffuser blades 102*e* can be formed of material different from the rest of the housing 102. Though manufacture of such an embodiment might be more costly due to increased complexity in the manufacture, it may be acceptable if the diffuser blades 102*e* can achieve high thermal efficiency.

The discussion will now turn to a description of additional embodiments of the present invention as shown in FIGS. 5-12.

Figure 5:
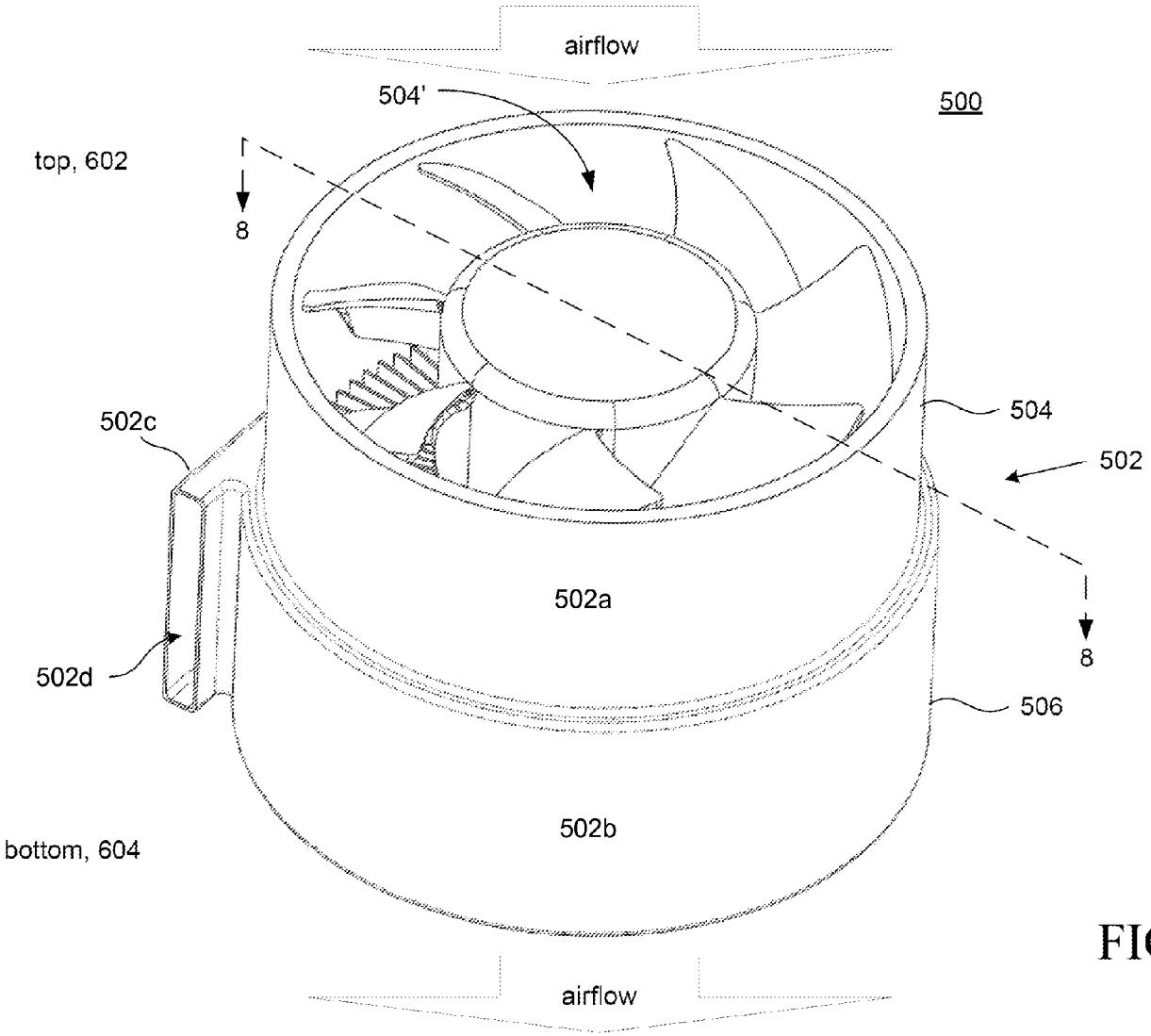
FIG. 5 is a perspective view of another illustrative embodiment of the present invention.

FIG. 5 shows a cooling unit 500 in accordance with another embodiment of the present invention. The cooling unit 500 includes a housing 502. The housing 502 comprises a fan shroud 502*a* that houses a fan component 504 of the cooling unit 500, and a casing 502*b* which houses a heat exchanger component 506.

Figure 5A:
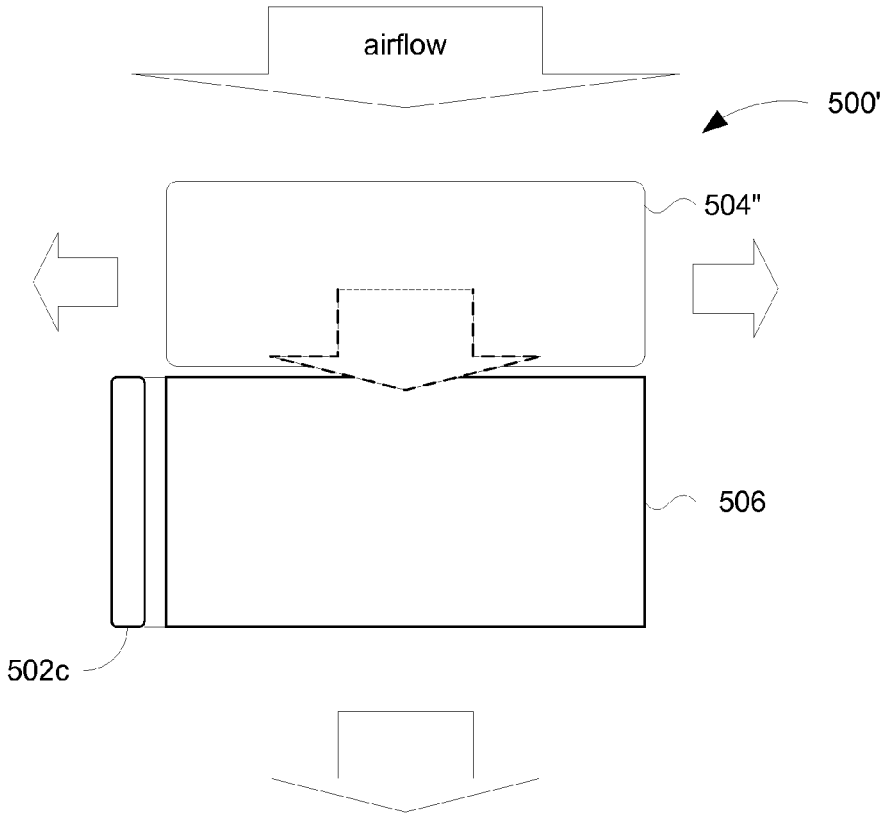
FIG. 5A is a profile view of an embodiment of FIG. 5 depicting a mix-flow fan.
Figure 6A:
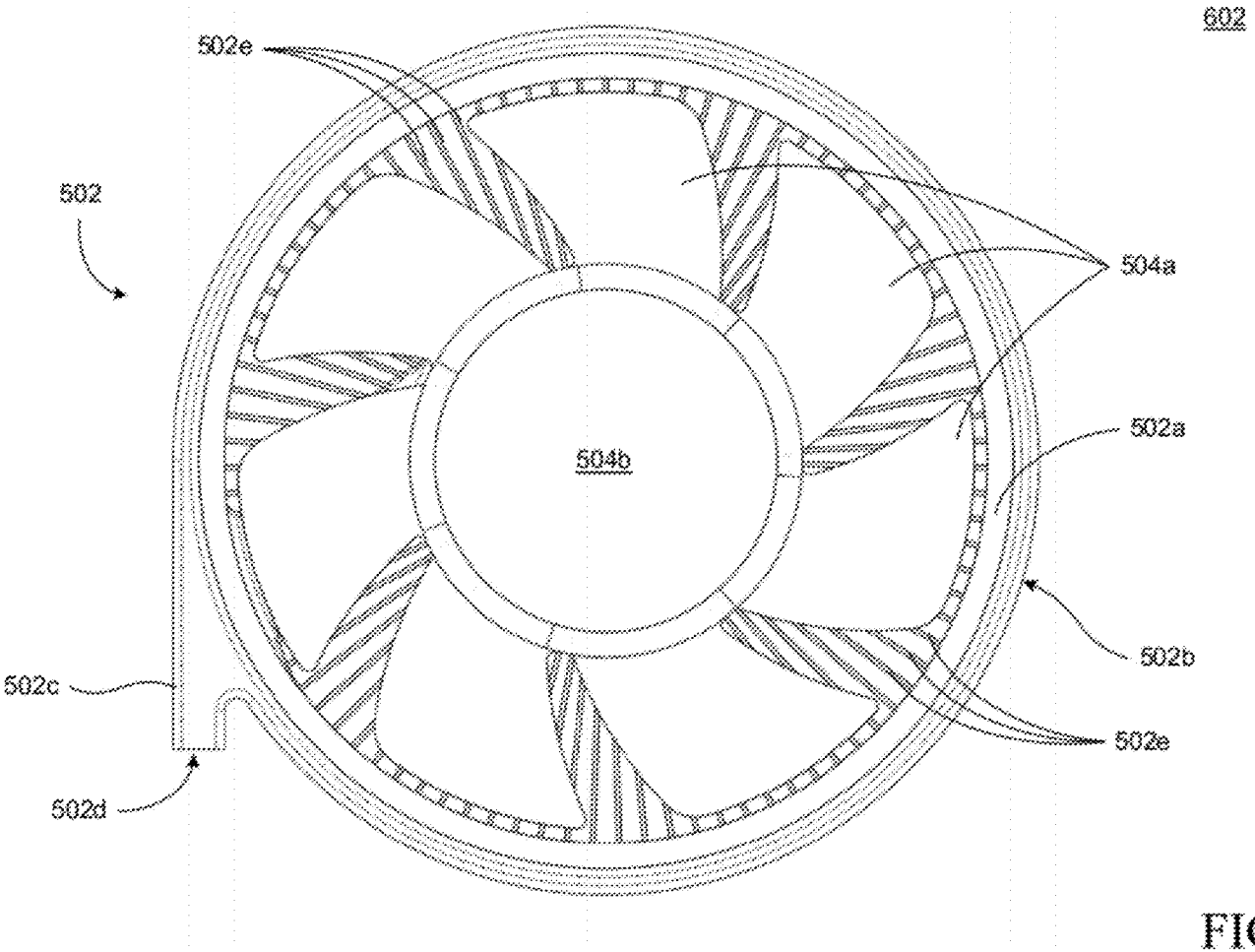
FIG. 6A is a top view looking down of the embodiment shown in FIG. 5

Referring to FIGS. 5, 5A, and 6A, a description of a first end 602 of the cooling unit 500 will be described, showing in more detail the parts comprising the fan component 504. FIG. 6A shows a top view of the cooling unit 500 looking downward. The fan component 504 includes an axial flow fan 504' disposed within the fan shroud 502*a*. The axial flow fan 504' is of conventional design and construction, comprising fan blades 504*a* connected to a hub 504*b*, and a motor that is not visible in the figure. As its name implies, the axial flow fan 504' creates a flow of air along the axis of rotation of the hub 504*b*. The figure also shows portions of the heat exchanger component 506, including heat exchange fins 502*e* and other parts of the casing 502*b* of the heat exchanger component. It is understood that the fan component 504 can be a so-called mixed-flow fan. For example, FIG. 5A shows a cooling unit 500' comprising a mix-flow fan component 504". Mix-flow fans provide air flow in the axial direction and in the radial direction.

Figure 6B:
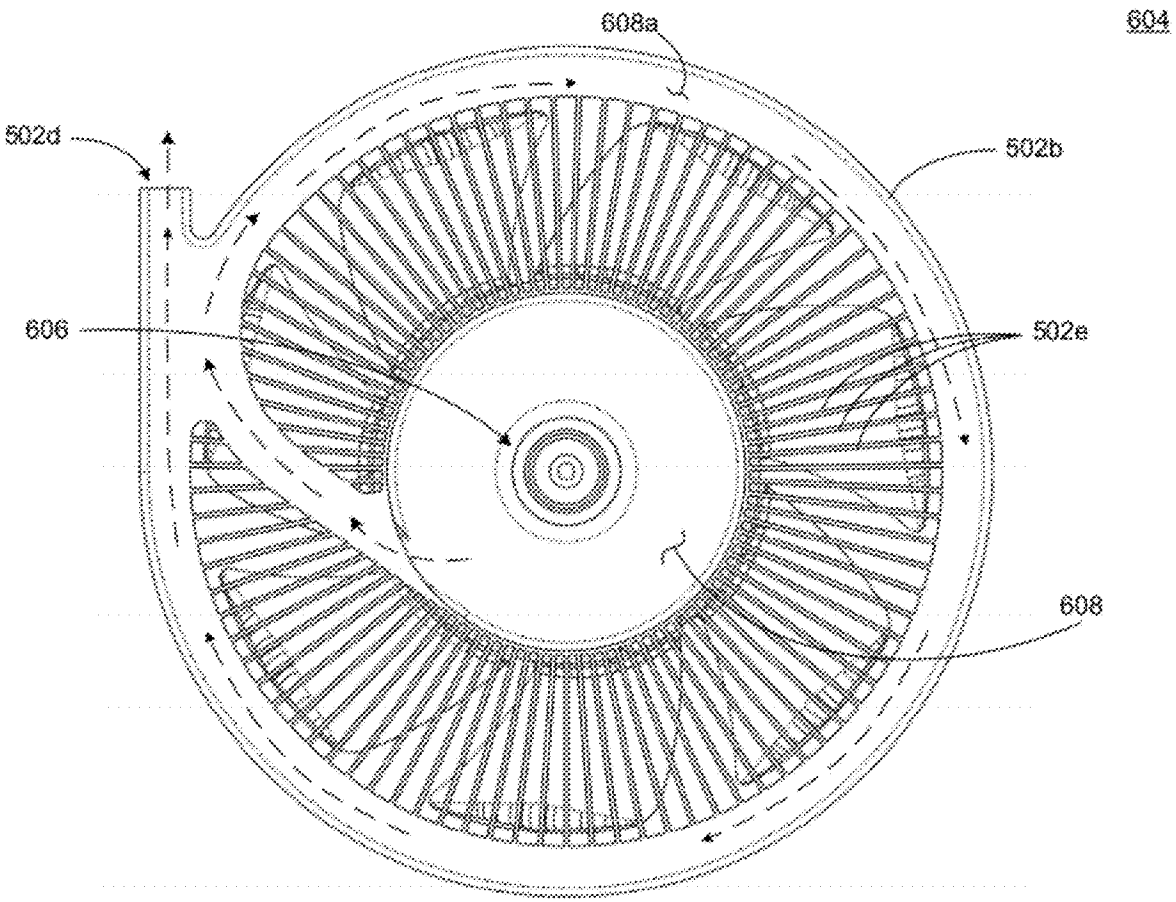
FIG. 6B is a bottom view looking up of the embodiment shown in FIG. 5

Referring to FIGS. 5 and 6B, a description of a second end 604 of the cooling unit 500 will now be described, showing in more detail the heat exchanger component 506. FIG. 6B shows an exterior bottom view of the cooling unit 500 looking up. The casing 502*b* defines a fluid channel 702 (FIG. 7A) within which a fluid flows, as indicated by the arrows. An inlet port 606 provides an inlet to the fluid channel. An outlet portion 502*c* of the casing 502*b* includes an exit port 502*d* for the fluid.

Figure 7A:
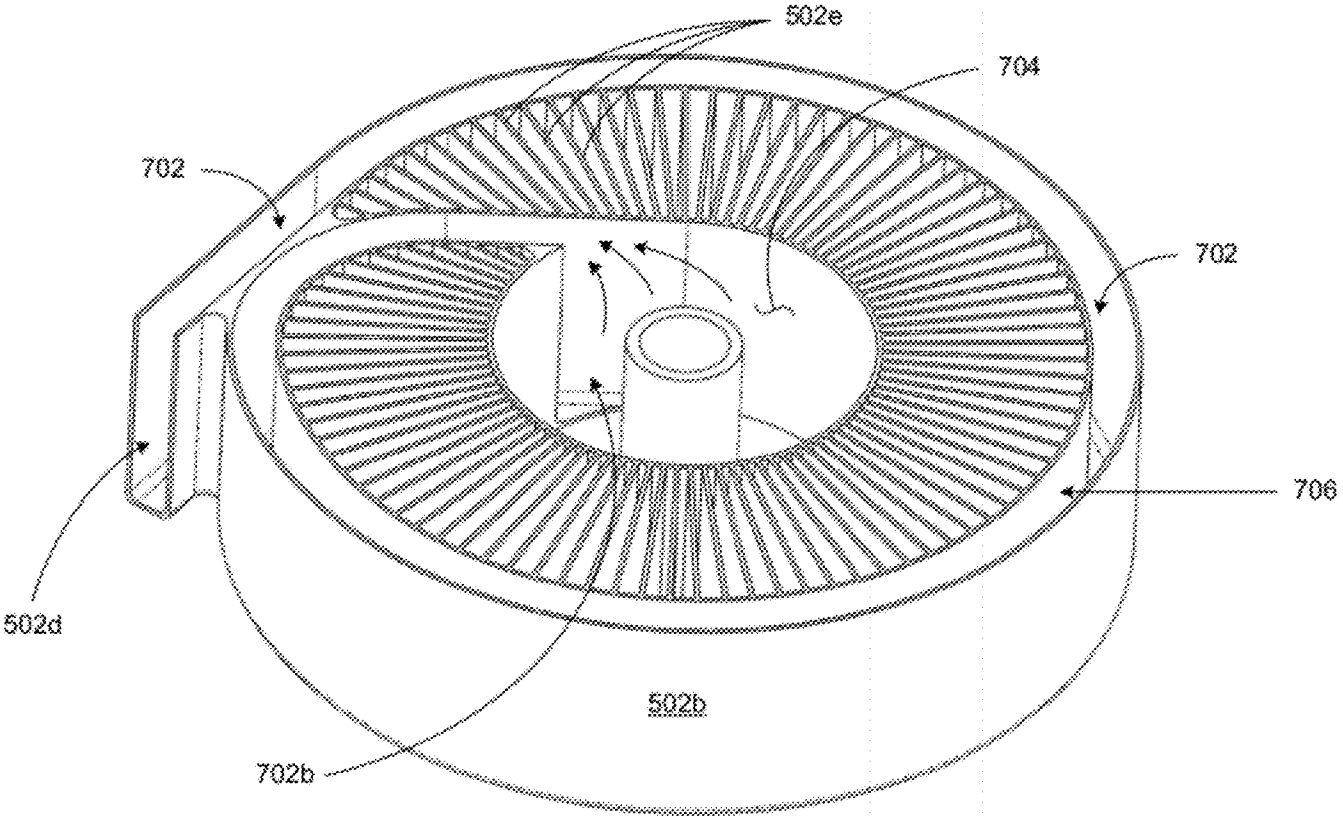
FIG. 7A provides additional detail of the heat exchanger housing 502*b*.

A shroud 608 houses a pump (not shown) that is coupled to the inlet port 606 which serves to pump the fluid to be cooled into the fluid channel 702 (FIG. 7A). The arrows in the figure indicate the direction of fluid flow within the fluid channel 702 as fluid is pumped into the fluid channel via the inlet port 606 and exits via the outlet port 502*d*. In the particular embodiment shown in FIG. 6B, the casing 502*b* is manufactured so as to expose the fluid channel 702. The particular casing 502*b* shown in the figure therefore includes a cover plate 608*a* that is provided to seal off the fluid channel 702.

FIG. 6B further shows a series of heat exchange fins 502*e* radially disposed about an axis of the casing 502*b*. As will be explained in further detail below, the heat exchange fins 502*e* serve to conduct thermal energy of the fluid flowing within the fluid channel 702. The axial fan 504' creates a flow of air across the heat exchange fins 502*e* to remove the heat that is conducted by the heat exchange fins. Though the disclosed embodiments of the present invention describe the flow of air created by the axial fan 504', it can be appreciated that the present invention is not necessarily limited to air flow. Instead, any fluid can be used, whether gas or liquid, with a suitably adapted axial flow fan.

In a typical configuration, the cooling unit 500 is used to remove heat generated by a heat generating object. The fluid is typically a cooling fluid (coolant) that absorbs heat from a heat generating object. The coolant is then pumped into the fluid channel 702. As the coolant flows through the fluid channel 702, heat exchange occurs between the coolant and the heat exchange fins 502*e*, where heat from the hotter coolant flows to the cooler heat exchange fins. The heat conducted to the heat exchange fins 502*e* is removed as it is conducted to the air flowing across the surfaces of the heat exchange fins created by the axial fan 504'. The heat is thus continuously removed from the coolant as it flows through the fluid channel 702. The coolant exits the outlet port 502*d* and can then be returned to the heat generating object to repeat the cycle. It will be appreciated that the coolant can be any fluid suitable for heat exchange.

FIG. 7A shows additional detail of the casing 502*b* of the heat exchanger 506. This figure shows the casing 502*b* with the cover plate 608*a* removed to illustrate the fluid channel 702. A fluid inlet region 704 is provided about a central axis of the casing 502*b*. Fluid entering the inlet port 606 by operation of a pump (not shown) disposed in the shroud 608 (FIG. 6B), is pumped into the fluid inlet region 704. Fluid entering the fluid inlet region 704 exits via the interface region 702*b* into the fluid channel 702, as indicated by the arrows. The fluid flows through the fluid channel 702 and exits the fluid channel via the exit port 502*d*.

The heat exchange fins 502*e* are a part of, attached to, or otherwise in thermal contact with the inside wall 706 of the fluid channel 702. As heated fluid flows through the fluid channel 702, heat is conducted from the fluid to the inside wall 706 by virtue of the fluid being in contact with the inside wall. The heat is thereby conducted from the inside wall 706 to the heat exchange fins 502*e*. In other words, a path for the conduction of heat from the fluid to the heat exchange fins 502*e* is provided. Consequently, it would be desirable that the inside wall 706 of the fluid channel 702 be characterized by a high thermal conductivity.

The heat exchange fins 502*e* can be separately formed elements that are attached to the casing 502*b* during manufacture. Accordingly, the heat exchange fins 502*e* can be formed from aluminum or its alloys. Of course, other similarly suitable materials can be used including but not limited to copper or its alloys, and even high thermal conductivity plastics. The heat exchange fins 502*e* can be formed by stamping, extrusion, folding, or by any other suitable and known technique. Alternatively, the casing 502*b* and heat exchange fins 502*e* can be entirely of one extruded piece. The choices of appropriate materials and manufacturing processes are matters relevant to the specific design parameters of a given cooling unit design and are not otherwise relevant to the disclosure of the present invention.

Figure 7B:
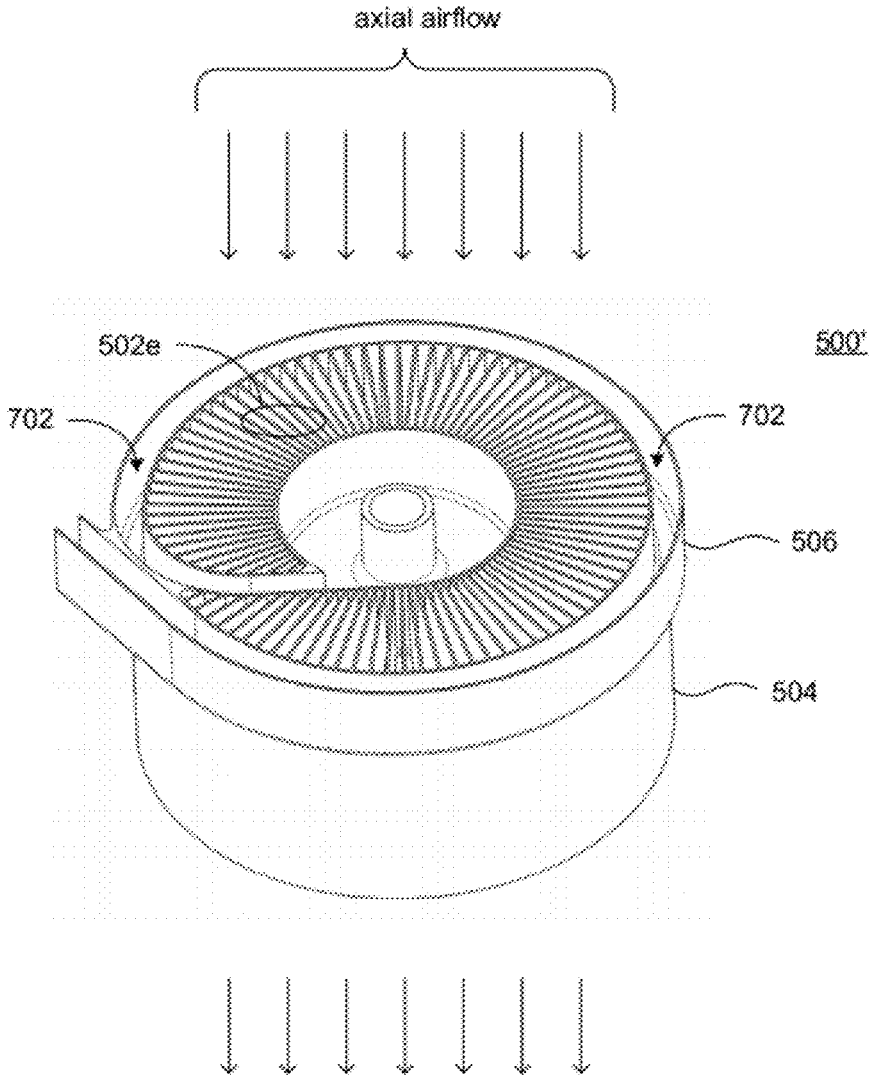
FIG. 7B shows an alternative construction of the heat exchanger housing 502*b*.

FIG. 7B shows an alternative arrangement of the fan component 504 and the heat exchanger component 506 (see FIG. 5). The heat exchanger component 506 is shown with the cover plate 608*a* removed to illustrate the interior fluid channel 702. The configuration in FIG. 5 shows the fan component 504 arranged atop the heat exchanger component 506, with the flow of air being drawn in from the fan component, through the heat exchanger component, and discharging from the bottom of the heat exchange component. The cooling unit 500' shown in FIG. 7B reverses the positions of the fan component 504 and the heat exchanger component 506, where the fan component is downstream of the heat exchanger component. Thus, the air flow passes through the heat exchanger component 506 first, then is drawn through fan component 504 where it is discharged through the bottom. The specific configuration may be dictated by space constraints and other factors of the particular application of the cooling unit that are not relevant to the discussion of the present invention. It is understood of course that the fan component 504 can be operated to pull the air from the heat exchanger component 506, or push the air into the heat exchanger component 506. However, it is understood by those of ordinary skill art that is preferable to pull air from the heat exchanger 506, such as shown in FIG. 7B.

Figure 8:
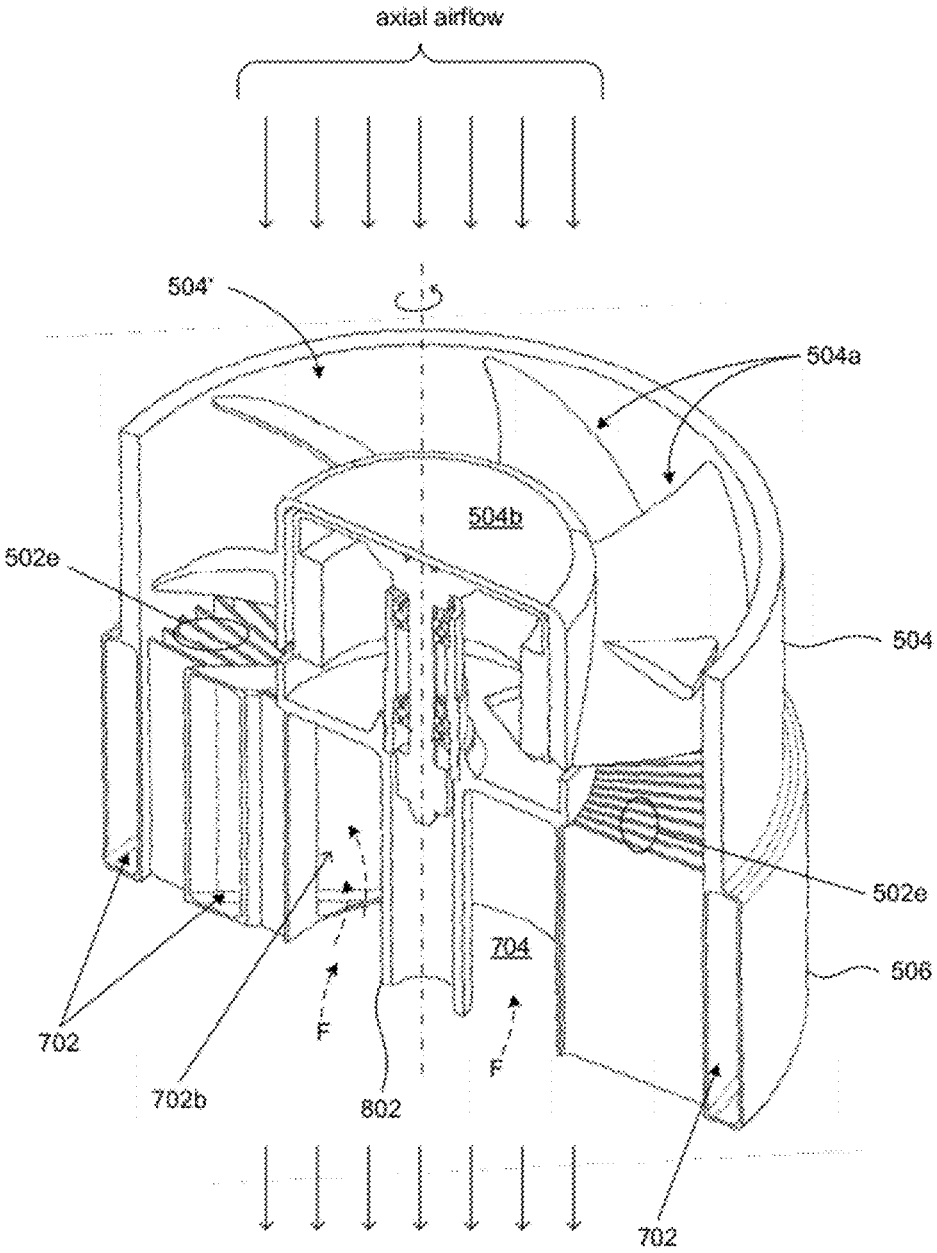
FIG. 8 shows a cut-away view taken along view line 8-8 in FIG. 5.

FIG. 8 illustrates a sectional view of the cooling unit 500 of FIG. 5, taken along view line 8-8. As can be seen the axial fan 504' is supported on a shaft 802. The sectional view also provides a perspective view of the general arrangement of the internal parts of the heat exchanger component 506. The heat exchanger fins 502*e* are arranged about the axis of rotation of the axial fan 504'. As can be seen, the axial fan 504' will create an axial flow of air that passes over the surfaces of the heat exchanger fins 502*e*. It will be appreciated that the airflow can be directed from the top to the bottom, as shown in the figure, or from the bottom to the top. Fluid F, having been heated from a heat generating object, is pumped into the fluid inlet region 704 and flows from the fluid inlet region into the fluid channel 702 across interface region 702*b*. As the heated fluid F travels through the fluid channel 702, its contact with the inside wall 706 allows for the conduction of heat from the fluid to the heat exchange fins 502*e*, thereby cooling the fluid. The fluid F that exits the port 502*d* is cooled and can then be recirculated back to the heat generating object to pick up more heat and thus repeat the cycle.

Figure 9:
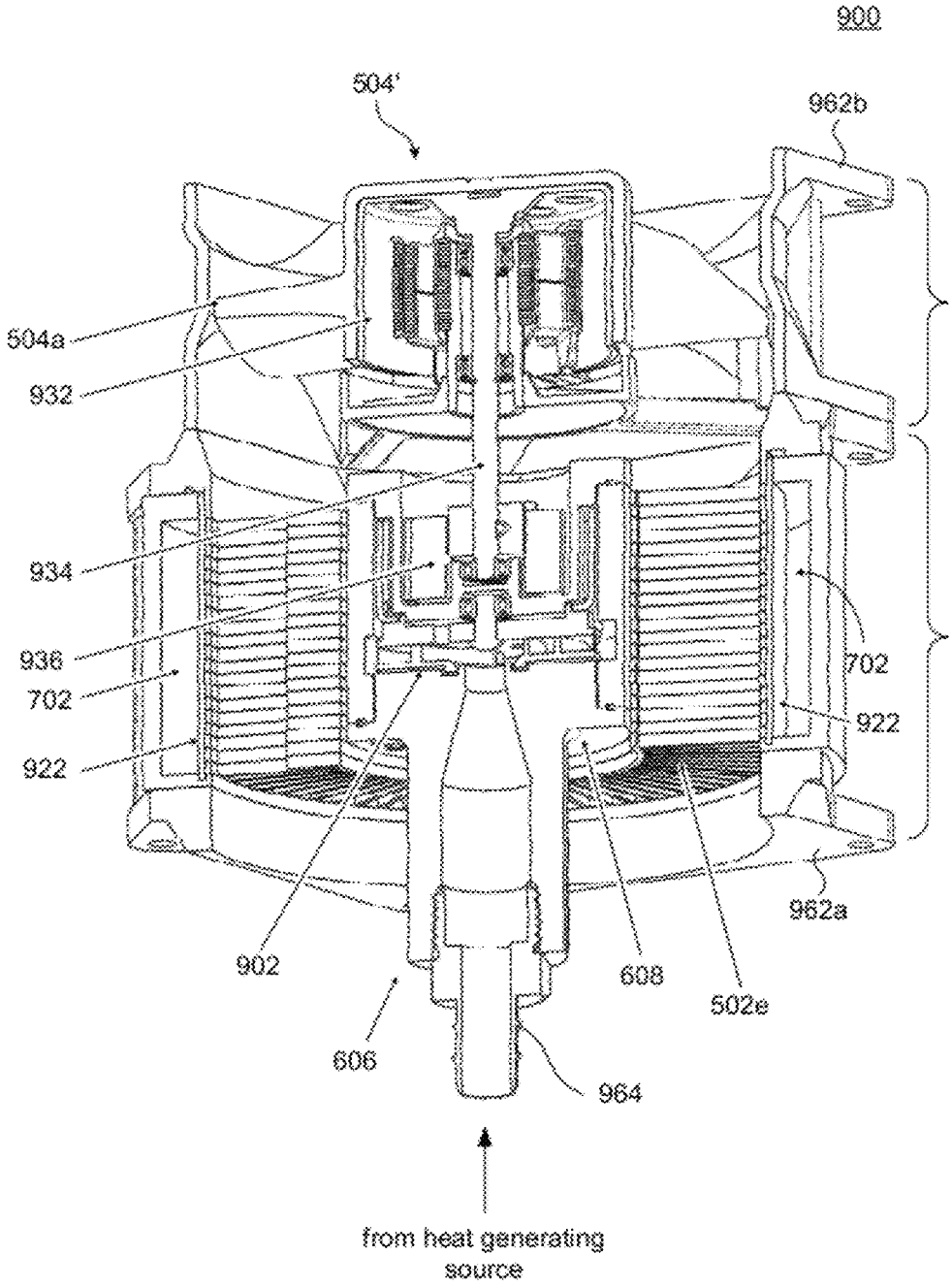
FIG. 9 is a cutaway view of a solid model rendering of an embodiment of the present invention.

FIG. 9 is a cutaway view of a solid model rendering of an embodiment of a cooling unit 900 similar to the cooling fan shown in FIG. 5. The cooling unit 900 illustrated in FIG. 9 includes mounting brackets 962*a*, 962*b* for mounting the cooling unit. The fan component 504 comprises axial fan 504'. The fan motor 932 is connected to a shaft 934, and thus turns both the fan blades 504*a* (which comprise the fan impeller) and the shaft. The shaft 934 is coupled to a water pump 902 via a magnetic couple 936. The fan motor 932 therefore turns the water pump 902. The magnetic couple 936 allows the water pump 902 to be water tight while at the same time be driven by the fan motor 932. It will be appreciated of course that in an alternative design, a separate motor can be provided to drive the water pump 902.

The cutaway view of FIG. 9 shows the inlet port 606, but does not show the exit port 502*d*. The figure shows a coupling 964 connected at the inlet port. The coupling 964 connects the cooling fluid from the heat generating source to the cooling unit 900. The cooling fluid absorbs heat from a heat generating source and is delivered to the cooling unit 900 to be cooled in the manner discussed above.

In the embodiment of the present invention shown in FIG. 9, a heat transfer element 922 is provided to serve as the inside wall 706 (FIG. 7A) component of the fluid channel 702. The heat exchanger fins 502*e* are connected to or otherwise in thermal contact with the heat transfer element 922. The fluid is in contact with the heat transfer element 922 as it flows through the fluid channel 702. Heat from the fluid flowing in the fluid channel 702 is absorbed by the heat transfer element 922. Due to the thermal contact of the heat transfer element 922 with the heat exchanger fins 502*e*, the heat that is absorbed by the heat transfer element is conducted (i.e., transferred) to the heat exchanger fins. The heat in the heat exchanger fins 502*e* is removed by the axial flow of air created by the axial fan 504'. The flow of air in this particular embodiment is in the direction from bottom to top. Although, it is understood that the fan can be configured to produce a flow of air from top to bottom.

The embodiment of the present invention shown in FIG. 9 shows a copper surface as the heat transfer element 922. Copper is a highly suitable material because of its high thermal conductivity. However, it will be appreciated that other thermally conductive materials can be used in place of copper if copper is not well suited for a given usage scenario.

To further facilitate the conduction of heat absorbed from the flowing fluid by the heat transfer element 922 to the heat exchange fins 502*e*, any of a number of well-known suitable thermal compounds (thermal grease, heat exchange compound) can be provided between the surface of heat transfer element and the heat exchange fins. If the casing 502*b* and heat exchange fins 502*e* are formed as one extruded piece, the use of a thermal compound may not be suitable.

Figure 10:
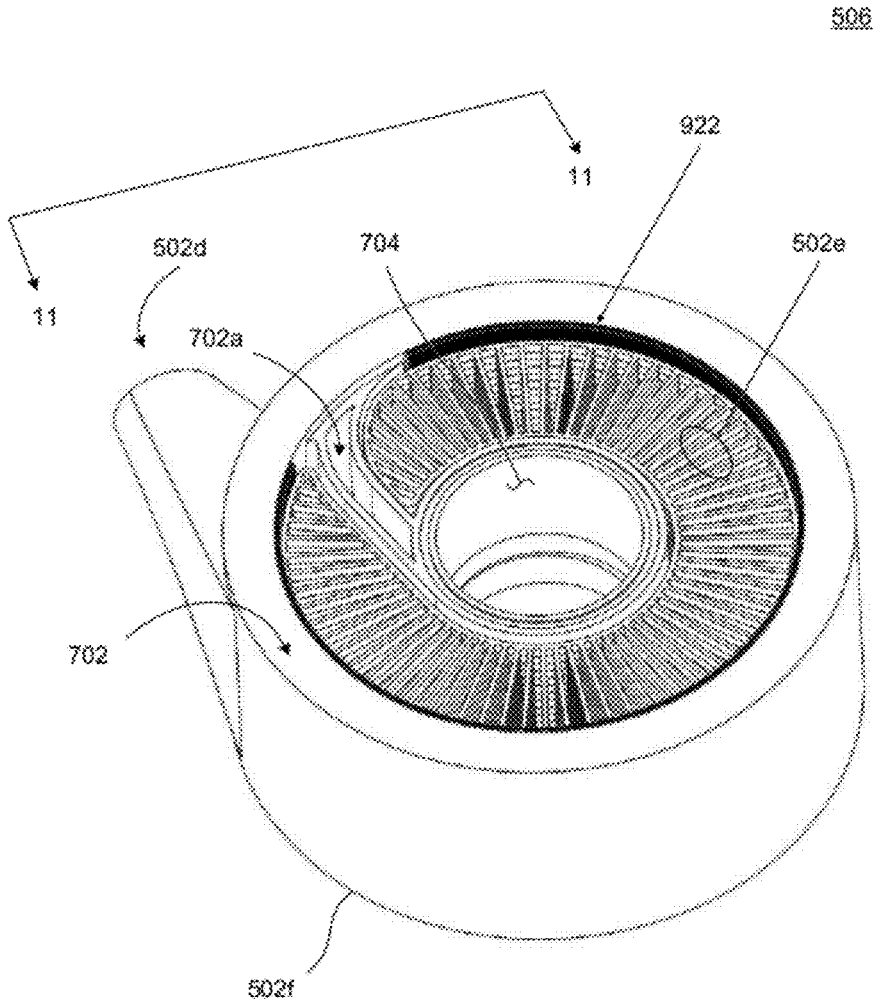
FIG. 10 is a solid model rendering of the heat exchanger 502*b*.

FIG. 10 shows a solid model rendering of a particular embodiment of the heat exchanger component 506. The particular heat exchanger component 506 shown in FIG. 10 comprises heat exchanger fins 502*e* disposed within a fluid housing 502*f*. The fluid housing 502*f* defines the fluid inlet region 704 into which the cooling fluid (e.g., water) is pumped. The fluid housing 502*f* includes a fluid bridge 702*a* and the fluid channel 702, the exteriors of which are shown in the figure. The cooling fluid that is pumped into the fluid inlet region 704 exits the fluid inlet region via the fluid bridge channel 702*a* and into the fluid channel 702. The cooling fluid flows through the fluid channel 702 and ultimately exits via the exit port 502*d* of the fluid housing 502*f* after making a complete loop around the heat exchanger fins 502*e*.

As indicated in FIG. 9, the heat transfer element 922 serves as the inside wall of the fluid housing 502*f*. The heat transfer element 922 is wrapped around and in thermal contact with the heat exchanger fins 502*e*. The heat exchanger fins 502*e* are therefore connected to the inside wall of the fluid housing 502*f* by virtue of their attachment to the heat transfer element 922. It will be appreciated that a suitable thermal paste can be applied between the heat exchange fins 502*e* and the heat transfer element 922 to optimize heat transfer. The heat transfer fins 502*e* can be formed as a single unit that fits within the interior space of the fluid housing 502*f*.

Figure 11:
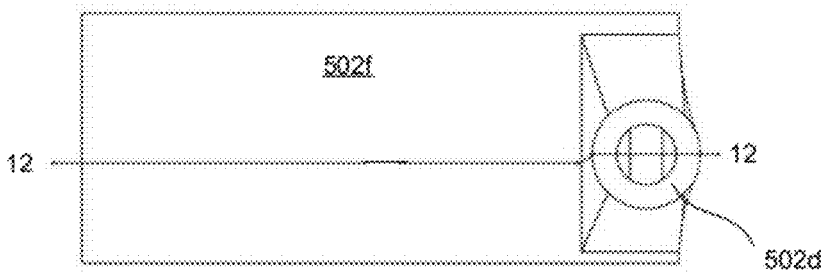
FIG. 11 is a plan view of the solid model rendering of FIG. 10.

FIG. 11 is a plan view of the fluid housing 502*f* of the heat exchanger component 506, view from the location along view line 11-11 illustrated in FIG. 10. The sectional curve line 12-12 indicates the cutaway view of the heat exchanger component 506 shown in FIG. 12.

Figure 12:
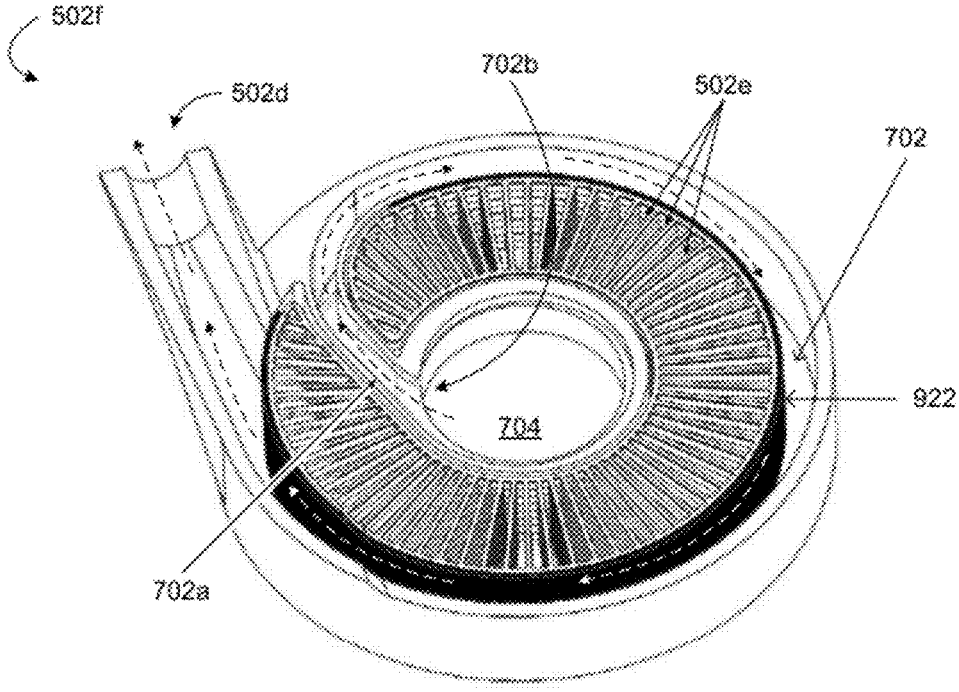
FIG. 12 is a cutaway view of a solid model rendering of the heat exchanger 502*b* shown in FIG. 10.

FIG. 12 shows a cutaway view of the heat exchanger component 506, providing further details of the interior of the fluid housing 502*f*. Interface region 702*b* is a region where the fluid inlet region 704 interfaces with the bridge channel 702*a*. Fluid is pumped into the fluid housing 502*f* by the water pump (not shown). The fluid enters the fluid housing 502*f* via the fluid inlet region 704 and enters the fluid channel 702 through the interface region 702*b*. The dashed arrows indicate the flow of the fluid from the fluid inlet region 704 to the exit port 502*d*. Any of a number of conventionally known water pumps can be suitably configured for use with the fluid housing 502*f*. The specific configuration of the fluid channel 702 and the interface region 702*b* will depend on the specific configuration of the water pump that is used.

The cutaway view shown in FIG. 12 reveals the heat transfer element 922, which forms the inside wall portion of the fluid channel 702. The heat transfer element 922 is fabricated from a material (e.g., copper) that is different from the material used to manufacture the remainder of the fluid housing 502*f*. The heat exchange element 922 is connected to or otherwise in thermal contact with the heat exchange fins 502*e*.

As fluid (e.g., water) flows through the fluid channel 702, it contacts the inside wall of the fluid channel, which in FIG. 12 is provided by heat transfer element 922. Heat is transferred from the fluid to the heat transfer element 922. Since the heat transfer element 922 is likewise in thermal contact with the heat exchanger fins 502*e*, the heat that is picked up by the heat transfer element is conducted to the heat exchanger fins. The heat exchanger fins 502*e* are cooled as the a flow of air created by the fan component 504 moves across the heat exchanger fins.

During operation of the cooling unit 500 (FIG. 5), the heat exchanger fins 502*e* will typically be at a lower temperature than the heat transfer element 922 due to the flow of air across the surfaces of the heat exchanger fins. Consequently, heat will typically be conducted from the heat transfer element 922 to the heat exchanger fins 502*e* because the former will by hotter than the latter. Similarly, the heat transfer element 922 will typically be at a lower temperature than the fluid that is pumped into the fluid inlet region 704 due to (1) the heat in the heat transfer element being conducted to the heat exchanger fins 502*e* and (2) the fluid being hot as it picks up heat from the external heat generating source. Consequently, heat will typically be conducted from the hotter fluid to the cooler heat transfer element 922.

The fluid that exits the cooling unit 500 (at exit port 502*d*) will therefore be cooler than the fluid the enters the fluid inlet region 704. The fluid that exits the cooling unit 500 can then be returned to the heat generating source (e.g., a CPU chip, or an engine component) to pick up more heat to repeat the cycle, thus cooling the heat generating source.

What is claimed is:

1. A cooling device comprising:

a housing having an air inlet and an air outlet; and an axial fan disposed within the housing to produce a flow of air along an axis of rotation of the axial fan, the flow of air entering the air inlet of the housing and exiting through the air outlet of the housing, the housing further having:

a plurality of heat exchange fins disposed in the path of the flow of air and arranged radially about the axis of rotation;

a fluid inlet defined by a wall that is connected to first edges of the heat exchange fins; and a fluid channel in fluid communication with the fluid inlet and in thermal contact with second edges of the heat exchange fins, wherein a fluid received in the fluid inlet is in direct contact with the wall that defines the fluid inlet and thermal energy of a fluid flowing in the fluid inlet and the fluid channel conducts to the heat exchange fins, whereby heat is conducted from the heat exchange fins as the flow of air passes across surfaces thereof.

2. The device of claim 1 further comprising a motor coupled to a fan impeller of the axial fan to produce the flow of air, the heat exchanger further comprising a pump coupled to the motor to pump fluid into the fluid channel via the fluid inlet.

3. The device of claim 1 wherein the fluid channel includes a fluid outlet to allow fluid contained therein to discharge.

4. The device of claim 1 wherein the fluid channel comprises an inside wall to which the heat exchange fins are in thermal contact.

5. The device of claim 4 wherein the inside wall comprises a thermally conductive material.

6. The device of claim 4 wherein the inside wall comprises a metal.

7. The device of claim 4 wherein the inside wall comprises copper.

8. The device of claim 1 wherein the axial fan is proximate the air inlet.

9. A cooling device comprising:

a fan for producing an airflow;

a heat exchanger proximate to the fan, the heat exchanger comprising a fluid path formed within an interior volume thereof and a plurality of fins radially disposed about an axis of rotation of the fan, the fluid path comprising an inlet defined by a first wall, a fluid channel defined by a second wall within the interior volume of the heat exchanger, and an outlet; and a pump axially aligned with respect to the axis of rotation of the fan and connected to the inlet, the pump operative to move a fluid into the fluid channel, wherein the fluid flows through the fluid channel and exits via the outlet, each of the fins having a first edge and a second edge connected respectively to the first and second walls, whereby fluid received in the inlet is in direct contact with the first wall, whereby heat in a fluid flowing through the inlet and the fluid channel is conducted to the fins via the first and second walls, the fins being disposed in the path of an airflow produced during operation of the fan, whereby heat in the fins is removed as the airflow passes across the surfaces of the fins.

10. The device of claim 9 wherein the fan comprises a motor connected to a shaft, wherein the shaft is connected to the pump, and operation of the fan concurrently operates the pump.

11. The device of claim 9 wherein the fluid channel is annular about the axis of rotation of the fan.

12. The device of claim 9 wherein the first and second wall comprise a metal.

13. The device of claim 9 wherein the first and second wall comprise copper.

14. The device of claim 9 wherein the fan is an axial fan or a mixed-flow fan.

15. The device of claim 9 wherein the fan is disposed downstream relative to the heat exchanger.

16. A cooling device comprising:

a fluid housing having a fluid input port and a fluid output port, the fluid housing including a fluid channel formed therewithin for the flow of fluid about a circumference of the fluid housing, the fluid housing having an axis about which the fluid channel circumnavigates;

a plurality of heat dissipation fins radially arranged about the axis of the fluid housing, the heat dissipation fins spaced apart allowing for a flow of air to pass across the heat dissipation fins in a direction substantially parallel to the axis of the fluid housing;

a wall of the fluid input port to which first edges of the heat dissipation fins are connected, wherein a fluid received within the fluid input port will be in direct contact with the wall; and a wall of the fluid channel to which second edges of the heat dissipation fins are connected, thereby enabling the conduction of thermal energy from a fluid flowing within the fluid channel to the heat dissipation fins.

17. The device of claim 16 wherein the inside wall comprises copper.

18. The device of claim 16 further comprising a fluid pump arranged along the axis of the fluid housing and connected to the fluid input port.

19. The device of claim 16 wherein the fluid input port is disposed along the axis and the fluid output port is disposed at an outer periphery of the fluid housing.

* * * * *